US012180976B2

(12) United States Patent
Arens et al.

(10) Patent No.: US 12,180,976 B2
(45) Date of Patent: Dec. 31, 2024

(54) CEILING FAN AIRFLOW DIFFUSER APPARATUS

(71) Applicant: THE REGENTS OF THE UNIVERSITY OF CALIFORNIA, Oakland, CA (US)

(72) Inventors: Edward A. Arens, Berkeley, CA (US); Hui Zhang, Moraga, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 18/328,937

(22) Filed: Jun. 5, 2023

(65) Prior Publication Data

US 2023/0392610 A1 Dec. 7, 2023

Related U.S. Application Data

(63) Continuation of application No. PCT/US2021/062260, filed on Dec. 7, 2021.

(60) Provisional application No. 63/122,940, filed on Dec. 8, 2020.

(51) Int. Cl.
*F04D 29/54* (2006.01)
*F04D 25/08* (2006.01)

(52) U.S. Cl.
CPC ..... *F04D 29/542* (2013.01); *F04D 25/088* (2013.01)

(58) Field of Classification Search
CPC ..... F04D 25/088; F04D 29/542; F04D 29/547
See application file for complete search history.

(56) References Cited

U.S. PATENT DOCUMENTS 5,440,459 A 8/1995 Chan
9,702,576 B2 7/2017 Avedon
10,316,141 B2 6/2019 Niemiec
(Continued)

FOREIGN PATENT DOCUMENTS

CN 106286347 1/2017

OTHER PUBLICATIONS

Zhang, Hui, et al., "A review of the corrective power of personal comfort systems in non-neutral ambient environments", Building and Environment, 91, 2015, pp. 15-41.
(Continued)

*Primary Examiner* — Courtney D Heinle
*Assistant Examiner* — John S Hunter, Jr.
(74) *Attorney, Agent, or Firm* — O'BANION & RITCHEY LLP; John P. O'Banion

(57) ABSTRACT

A ceiling fan airflow diffuser apparatus and system that creates elevated air speeds indoors for cooling occupants, improving room air circulation, and reducing energy use by the cooling system of the building. The apparatus has a diffuser support structure and diffuser body oriented below the blades of a ceiling fan. The diffuser body has an outer rim with an annular opening and a top surface forming a shroud for the fan blades. A smaller concentric inner ring positioned coaxially in relation to the outer rim is joined to the outer rim with struts. The inner ring has a frustoconical shape with a central opening. The outer rim and inner ring may also have directional visible light sources to provide flicker-free lighting, or an integrated UV-C light source oriented in an upward direction to inhibit airborne pathogens exposed to the light source.

3 Claims, 4 Drawing Sheets

(56) References Cited

U.S. PATENT DOCUMENTS

| | | | | |
|---|---|---|---|---|
| 10,677,250 | B2 | 6/2020 | Seccareccia | |
| 11,536,284 | B2 * | 12/2022 | Cunnane | F04D 29/441 |
| 2009/0129974 | A1 | 5/2009 | McEllen | |
| 2013/0251521 | A1 | 9/2013 | Kan | |

OTHER PUBLICATIONS

Zhai, Yongchao, et al., "Human Comfort and Perceived Air Quality in Warm and Humid Environments with Ceiling Fans", Building and Environment, 90, 2015, pp. 178-185.

Hoyt, Tyler, et al., "Extending air temperature setpoints: Simulated energy savings and design considerations for new and retrofit buildings", Building and Environment, 88, Sep. 2014, pp. 89-96.

Gao, Yunfei, et al., "Ceiling fan air speeds around desks and office partitions", Building and Environment, 124, Nov. 1, 2017, pp. 1-14.

Linnes, J. C., et al., "Eggcrate UV: A Whole Ceiling Upper-Room Ultraviolet Germicidal Irradiation System for Air Disinfection in Occupied Rooms", Indoor Air, vol. 24, No. 2, Apr. 2014, pp. 116-124.

Raftery, Paul et al., "Ceiling fans: Predicting indoor air speeds based on full scale laboratory measurements", Building and Environment, 155, May 1, 2019, pp. 210-223.

Kent, Michael G. et al., "Experimental evaluation of visual flicker caussed by ceiling fans", Building and Environment, vol. 182, Jul. 1, 2020, pp. 1-30.

Rudnick, S. N. et al., "Influence of Ceiling Fan's Speed and Direction on Efficacy of Upperroom, Ultraviolet Germicidal Irradiation: Experimental", Building and Environment 92, Oct. 2015, pp. 756-763.

Zhu, Shengwei et al., "Numerical investigation of upper-room UVGI disinfection efficacy in an environmental chamber with a ceiling fan", Photochemistry and Photobiology, vol. 89, No. 4, 2013, pp. 782-791.

Kim, Do-Kyun et al., "UVC LED Irradiation Effectively Inactivates Aerosolized Viruses Bacteria, and Fungi in a Chamber-Type Air Disinfection System", Applied and Environmental Microbiology, vol. 84, Issue 17, Sep. 2018, pp. 1-11.

* cited by examiner

CEILING FAN AIRFLOW DIFFUSER APPARATUS

CROSS-REFERENCE TO RELATED APPLICATIONS

This application claims priority to, and is a 35 U.S.C. § 111(a) continuation of, PCT international application number PCT/US2021/062260 filed on Dec. 7, 2021, incorporated herein by reference in its entirety, which claims priority to, and the benefit of, U.S. provisional patent application Ser. No. 63/122,940 filed on Dec. 8, 2020, incorporated herein by reference in its entirety. Priority is claimed to each of the foregoing applications.

The above-referenced PCT international application was published as PCT International Publication No. WO 2022/125582 A1 on Jun. 16, 2022, which publication is incorporated herein by reference in its entirety.

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

This technology pertains generally to systems and methods for creating elevated air speeds indoors for cooling occupants and improving room air circulation, and more particularly to an airflow diffuser and light ring apparatus that spreads air velocity from a ceiling fan more widely within the occupied zone of rooms, thereby enabling reduced energy use by the building's cooling system, and also simplifies the integration of ceiling fans with room lighting systems to provide flicker-free lighting.

2. Background

Managing proper air quality, conditioned air distribution and comfortable temperatures within indoor spaces can be challenging. Many indoor spaces are only served by a heating, ventilation and air conditioning (HVAC) system that utilizes a thermostat and a series of ducts for conditioned air distribution. Such HVAC systems are inherently limited in their cooling mode in that they cannot take advantage of the cooling of occupants by room air movement. Because HVAC provides a supply of chilled air that causes uncomfortable drafts if directed to an occupant, the supply air must be mixed with room air and slowed down by the time it reaches the occupant. For such still air to cool an occupant, it must be a cooler temperature than if that air were moving. Cooling air is much more energy-intensive for cooling compared to moving room air around the occupant for cooling. That is why adding ceiling fans to rooms is an energy-efficient strategy for cooling.

Studies have shown that ceiling fans can raise the comfortable ambient air temperature for occupants by more than 3° C. (5° F.) in the zone of influence of the fan. When ceiling fans are employed throughout a building, the air-conditioning (HVAC) cooling temperature setpoint of the building can be raised by an equivalent amount. Each 1° C. of cooling setpoint increase, for example, can reduce the total annual HVAC energy consumption of a building by about 10%.

Efficient ceiling fans have low energy requirements, typically drawing only 6 W to 10 W of energy, which is a negligible amount compared to the energy needed to provide equivalent cooling by the HVAC system (hundreds of watts per occupant). Therefore, the use of ceiling fans to reduce the mechanical air-conditioning requirements of a building presents a huge energy saving potential. This potential saving applies at the building, national, and global scales.

Ceiling fans are generally configured to run in the downward direction during the cooling season in order to create air movement around the occupants situated below the fans. However, the air velocity distribution in the occupied zone under a ceiling fan is highly non-uniform. This is due to the manner in which the ceiling fan creates characteristic air movements.

There is a high-velocity cylindrical downward jet emanating from a circular area within the radius of the fan blades, extending down as far as the floor and then spreading radially outward in a shallow layer near the floor. The air velocities are much smaller outside of the downward jet and above the shallow spreading layer, compared to the air velocities of the jet.

This non-uniformity limits the effectiveness of ceiling fans in rooms, especially in office spaces, where the occupants cannot all be situated directly under the fan. It also limits fans from being operated at their higher speed levels, since the air within the jets might prove annoying or uncomfortable to occupants while the surrounding air movement is satisfactory. Higher usable fan speed levels produce more energy savings because the cooling temperature set point can be increased as the air speed in the room increases.

The efficiency of a ceiling fan is also reduced by pressure losses resulting from tip vortices that form naturally at the end of the blades. The amount of this loss depends on the fan blade design, but it exists for all blade (or wing) tips that are not shrouded by or enclosed in a circular duct. The unshrouded blade tip pressure losses cause the fan's cylindrical air jet diameter to be approximately 75% that of the diameter of the area swept by the blades, or of a cylindrical duct enclosing the fan. The air volume propelled by the fan, and its serviceable area, is reduced accordingly.

There is another limitation to the wide-spread adoption of ceiling fan applications in buildings. Under some conditions, the interception or reflection of light from overhead lighting systems on the moving blades of the fan creates flickering that is perceptible at the desktop level. The flickering of ceiling-fan blades can cause significant visual discomfort for some people. Both direct upward and oblique views of ceiling light sources can be intercepted by fan blades. Therefore, even when light sources are not positioned immediately above the fan, the moving fan blades may still cause flickering from certain view angles from below.

Coordinating the position and light-emission of lighting fixtures relative to ceiling fans is complex and restricts the variety of lighting options available to designers. Accordingly, it would be advantageous if flicker-producing views of light sources through fan blades could be blocked. It would also be desirable to combine the functions of providing light and air movement into one fixture, eliminating the need for coordinating the positions of two systems.

BRIEF SUMMARY

Systems, methods, and devices for air distribution and circulation management with optional light sources are provided that can reduce the HVAC demand within an indoor space. The system generally includes a fan, such as a ceiling fan, in combination with an airflow diffuser apparatus with one or more directed light sources and a mounting structure.

A single ceiling fan airflow diffuser apparatus is described to illustrate the system and methods; however, it will be understood that fan may be any type of axial flow (e.g., propeller) fan. It will also be appreciated that the apparatus will work with any ceiling mounted fan corresponding to the size of the apparatus. It also will be appreciated that the apparatus can be scaled to work with any size, blade number or blade size of conventional ceiling fan.

In one embodiment, the apparatus comprises two connected rings; an inner/lower ring shaped like a shallow cone with the center open (referred to herein as the a "Ring") and an outer ring acting as a shroud and safety rim just outside the sweep of the ceiling fan blade tips (referred to herein as the "Rim"). The diffuser (1) provides more uniform air movement into the occupied zone and (2) distributes the air movement across a larger area than a conventional ceiling fan.

The ring and the rim elements are concentric rings that are positioned co-axially and the rim as a diameter that is larger than the diameter of the inner ring so that the rim essentially encircles the ring. The ring is also generally positioned at a level lower than the level of the Rim.

In one embodiment, the ring comprises a shallow cone-shaped structure with its inner central area open. The diameter of the open center and the slope of the cone can be designed differently (during the design process but is not adjustable) depending on the level of the velocity and the coverage floor area needed. In use, the ring is placed directly beneath the ceiling fan blades. The cone shape of the ring divides the airflow from the ceiling fan into (1) downward flow through the open center region, and (2) downward and radial outward flow primarily along the upper surface of the ring.

The diameter of the open cone center and the slope of the cone determine the proportion of the air moving within the center of the jet versus the proportion of air moving to the outside of the jet and extending its radius. The blades also can be airfoil shaped to minimize aerodynamic losses to the airflow distribution produced by the fan.

The diffuser also adds a safety feature to ceiling fans by impeding the potential contact of hands or objects with the rotating blades of the fan.

Furthermore, the shape of the diffuser reduces visual flicker from the rotating blades intercepting light from a room overhead lighting system. In one embodiment, electric lighting can be applied to the lower surfaces of the ring and the rim, and to the upper surface of the rim.

When used with a ceiling fan, the apparatus redirects portions of the downward airflow from the ceiling fan to cover a larger area of the occupied zone of the room more uniformly. The apparatus diffuses a portion of the airflow beyond the outside of the cylindrical jet below the fan blades, thereby reducing the air velocity directly under the fan blades and spreading it over a wider area.

In one embodiment, the upward-facing lighting can be UV-C that can irradiate the fan air circulation to kill bacterial and viral particles within the room. The UV-C light sources can be located anywhere in the rim or ring features, but they are preferably installed where the source is not visible to occupants observing the diffuser structure.

According to one aspect of the technology, an air circulation system is provided that can allow an increase in thermostat set points and reduce the total annual HVAC energy consumption of a building.

According to another aspect of the technology, an air circulation system with a combination of a ceiling fan and air diffuser is provided that improves the distribution of forced conditioned air in the room, reduces temperature variations and improves comfort.

Another aspect of the technology is to provide a system with a ceiling fan and diffuser apparatus that redirects portions of the downward airflow from the ceiling fan to elevate the air speeds within a larger volume of the room, thereby increasing the amount and uniformity of occupant cooling enabled by the fan.

Yet another aspect is to provide an apparatus that redirects a portion of the cylindrical downward airflow below the fan blades laterally outward and downward in a ring jet, thereby reducing the air speed under the fan blades and spreading elevated air speeds across a wider area below the fan.

Yet another aspect is to provide an apparatus that redirects a portion of the cylindrical downward airflow below the fan blades laterally outward and downward in a ring jet, thereby reducing the air speed under the fan blades and spreading elevated air speeds across a wider area below the fan.

A further object of the technology is to provide a diffuser apparatus that can uniformly manage air uniformity, provide a non-flickering light source and that can be sized and adapted for use with existing ceiling fans.

Another aspect of the technology is to provide a diffuser with integrated visible light sources that can be directed in either an upward or downward direction or both as well as an integrated UV-C light source that can be pointed in an upward direction to inhibit and/or kill airborne pathogens converging toward the fan inlet, and within the room volume above the fan.

Further aspects of the technology described herein will be brought out in the following portions of the specification, wherein the detailed description is for the purpose of fully disclosing preferred embodiments of the technology without placing limitations thereon.

BRIEF DESCRIPTION OF THE SEVERAL VIEWS OF THE DRAWINGS

The technology described herein will be more fully understood by reference to the following drawings which are for illustrative purposes only.

DETAILED DESCRIPTION

Referring more specifically to the drawings, for illustrative purposes, systems, devices and methods for air distribution and circulation management are generally shown. Several embodiments of the technology are described generally in FIG. 1 to FIG. 5 to illustrate the characteristics and functionality of the devices, systems and methods. It will be appreciated that the methods may vary as to the specific steps and sequence and the systems and apparatus may vary as to structural details without departing from the basic concepts as disclosed herein. The method steps are merely exemplary of the order that these steps may occur. The steps may occur in any order that is desired, such that it still performs the goals of the claimed technology.

Strategic use of ceiling fans has the potential to greatly reduce the total HVAC cooling energy requirements in both commercial and residential buildings worldwide. By increasing air motion within the occupied space, fans can provide equal comfort at higher thermostat setpoint temperatures, reducing the energy use of typical HVAC systems by 20 percent to 50 percent. However, the high spatial variability of ceiling fan air flow in the occupied space is a barrier to their adoption because air flows tend to be much higher directly beneath the fan. This variation can cause regions of discomfort directly beneath the fans (e.g., too cool) or in-between fans (e.g., too warm), limiting the full energy and comfort benefits of the fan.

Figure 1:
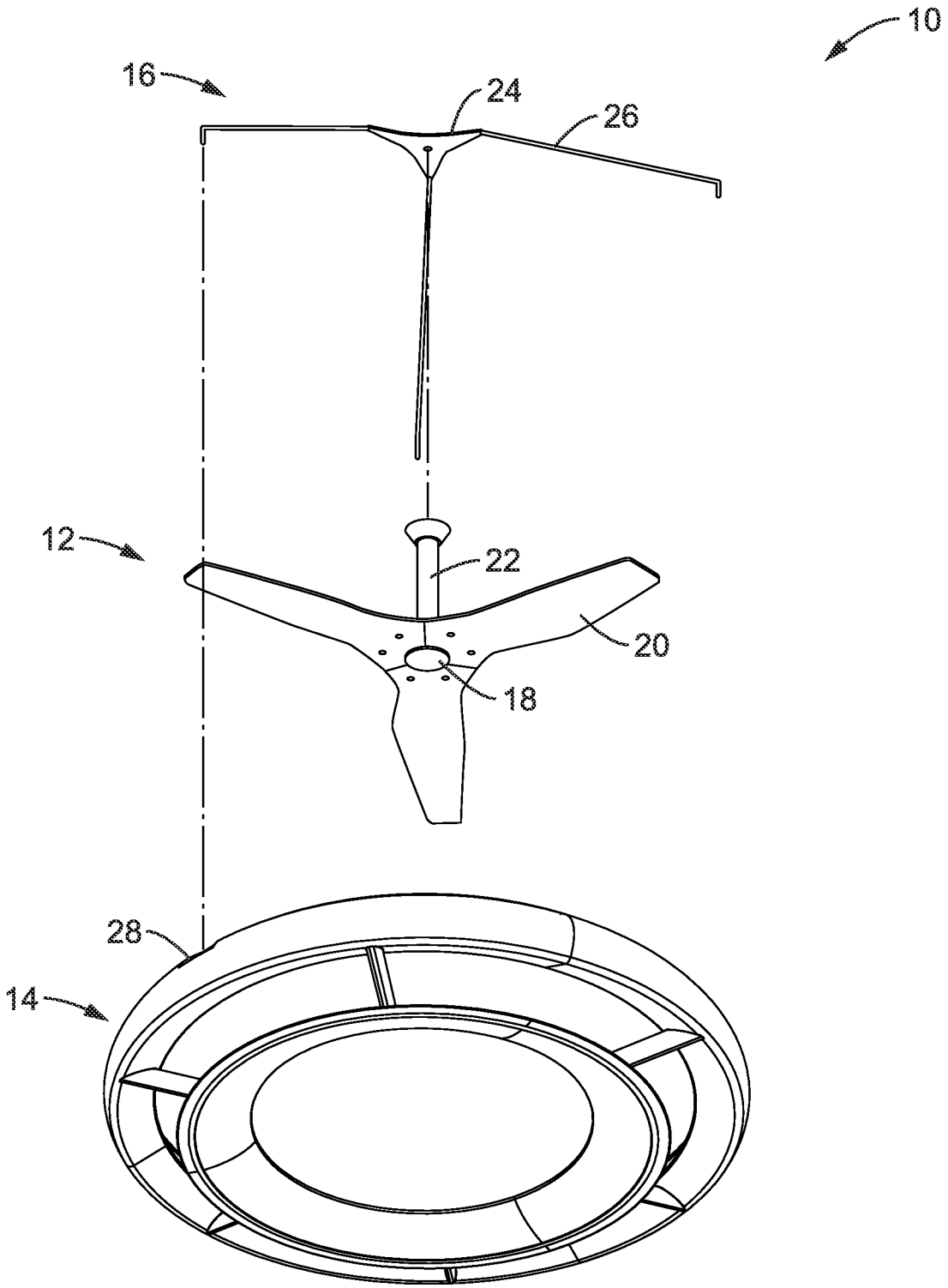
FIG. 1 is an exploded schematic view of the diffuser system with diffuser body, suspended fan and support structure according to one embodiment of the technology.

Turning now to the exploded view of FIG. 1, an embodiment of the system 10 for managing occupant comfort conditions, increasing air and temperature uniformity, and reducing HVAC energy demands in indoor spaces is shown schematically. The system 10 generally includes a fan 12, a diffuser 14 and a suspension structure 16 for mounting the diffuser to the ceiling and orienting the diffuser 14 with respect to the blades 20 of the fan 12.

In one embodiment, the motor 18 and blades 20 of fan 12 are integrated into the diffuser 14 structure and mounted to the ceiling with suspension structure 16. In another embodiment, the suspension structure 16 and diffuser 14 are mounted separately from an existing ceiling fan 12 that is incorporated into the system 10. In a further embodiment, the suspension structure 16 of the diffuser 14 is mounted to an existing ceiling fan suspension down rod 22 or to the fan motor 18.

The diffuser structure 14 can be sized and fitted to any ceiling fan 12 to produce a more uniform air velocity distribution in the occupied space and as well as provide a location for visible (for general lighting) and UV-C (for reducing airborne pathogens) light sources.

In the embodiment shown in FIG. 1, the suspension structure 16 has a central mount 24 for fastening the structure to the ceiling. Three leg supports 26 are coupled to the central mount 24 at one end and to the diffuser 14 body at the other with a coupling 28. The leg supports 26 can be solid, tubular or telescoping elements or they can be made from flexible metal cables, for example. Although three supports are shown, more than three leg supports 26 can be used in the suspension structure 16 to properly position and support the diffuser 14 with respect to the blades 20 of the fan 12.

Figure 2:
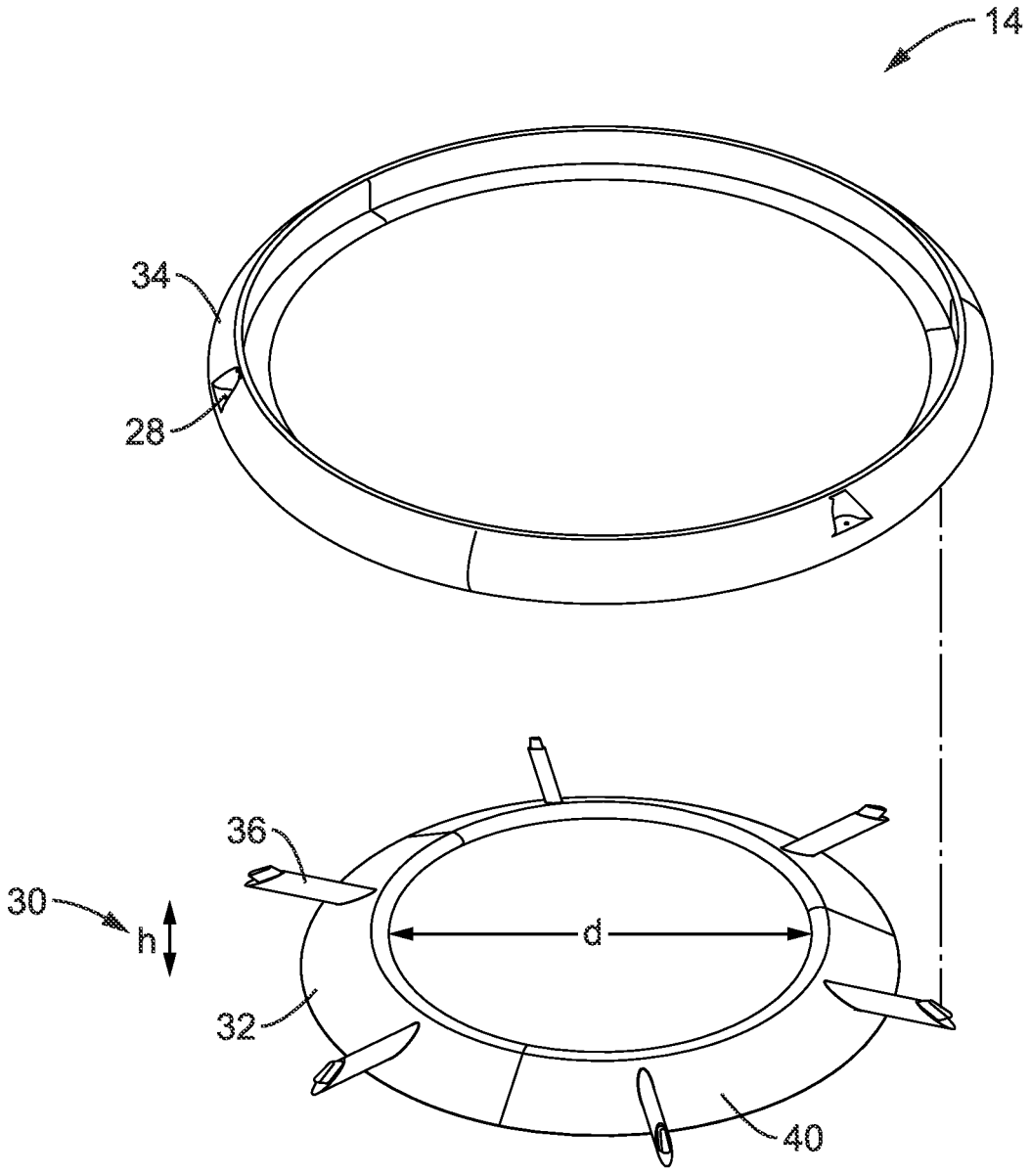
FIG. 2 is an exploded schematic view of the diffuser body showing the inner ring, radiating struts and outer rim elements according to one embodiment of the technology.
Figure 3:
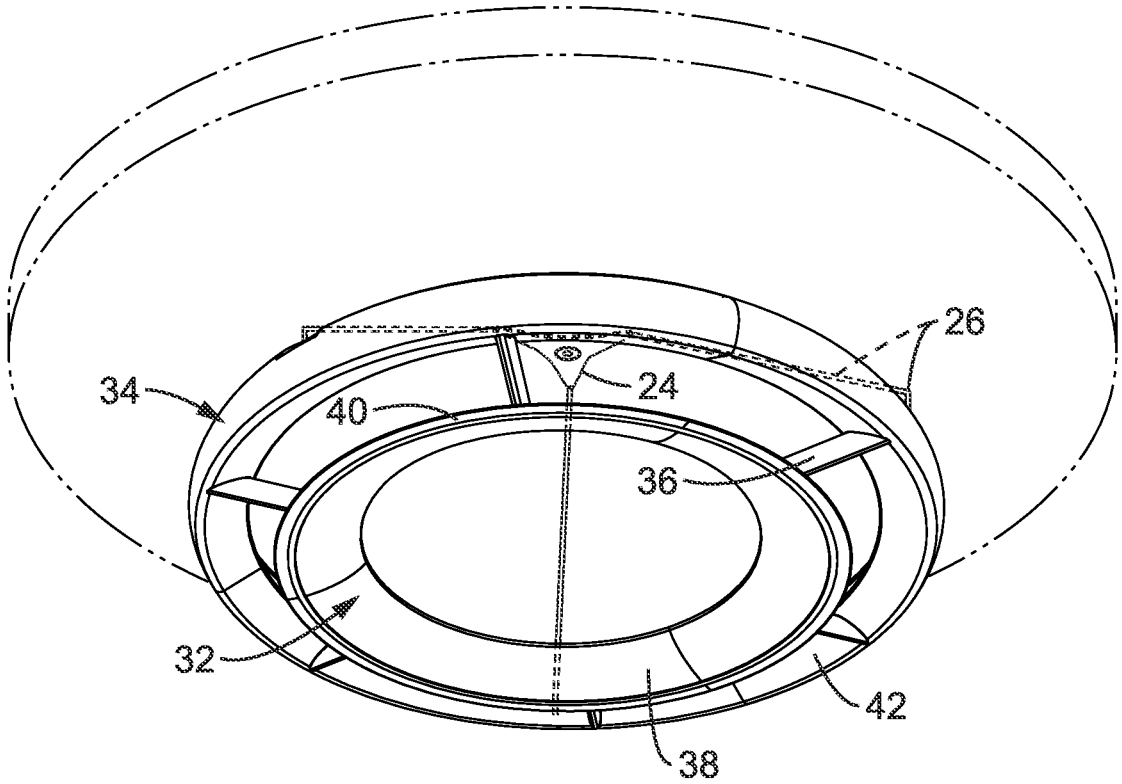
FIG. 3 is a bottom perspective view of a mounted diffuser and support structure according to one embodiment of the technology.
Figure 4:
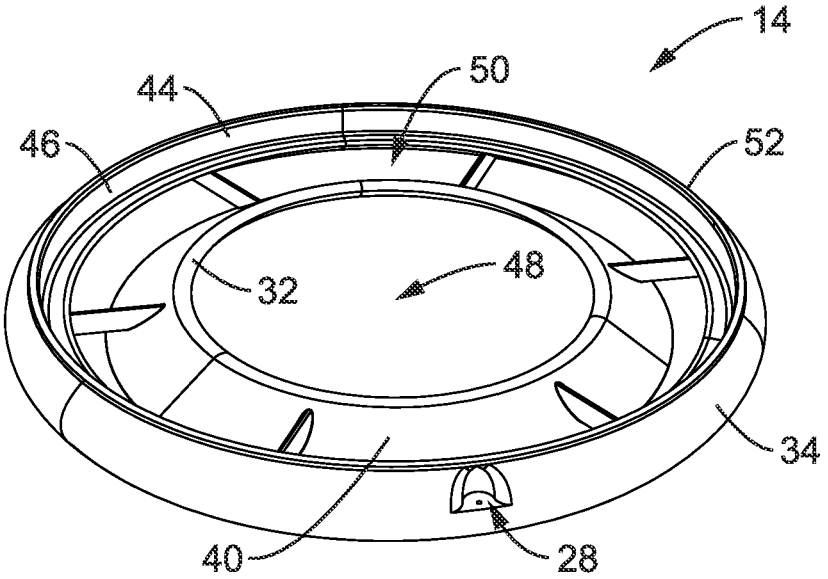
FIG. 4 is a top perspective view of a diffuser body of FIG. 3 without the mounting structure.

As seen in the exploded view of FIG. 2 and the bottom perspective view of FIG. 3 and top perspective view of FIG. 4, the diffuser structure 14 is formed from coaxial and concentric inner ring 32 of a selected height (h) 30 and outer rim 34 elements that are spaced and joined together with struts 36 that extend radially from the inner ring 32. An increase in height (h) of the frustoconical inner ring 32 will decrease the diameter of the central opening of the inner ring 32. The diameter of the inner cone opening and the slope of the truncated cone walls determine the coverage area by the air movement and the magnitude of the velocity in the area.

In one embodiment, the circular outer rim 34 may be coupled slightly above and outside of the ring 32 so that the bottom section of the inner ring 32 is parallel to but below the plane of the bottom edge of the outer rim 34.

The struts 36 are preferably shaped and oriented to be streamlined to avoid the creation of resistance and turbulence. For example, the struts 36 may be shaped as airfoils to minimize aerodynamic losses. However, the struts 36 may also have a cylindrical, elliptical, or rectangular cross-section. The length, size and shape of the struts may also be determined based on the size of the fan to be used with the apparatus.

While six struts are shown for illustration, fewer or more struts 36 can be used. However, six struts 36 is considered to be optimum because no further benefit from adding more struts 36 connecting the rim 34 to the ring 32 was observed. Another reason for using six struts allows modularization of the apparatus to be shipped in three 120-degree circumferential segments, with the ring and rim pre-connected with two struts each, in one embodiment.

In the embodiment of FIG. 3, the inner ring 32 has a frustoconical shape with a top open center with a selected diameter and a larger bottom opening with a selected diameter. The inner ring 32 has an inner surface 38 and an outer surface 40 that faces an inner surface 42 of the outer rim 34. The diameter and slope of the inner surface 38 and outer surface 40 of the inner ring 32 and inner surface 42 of the outer rim 34 will determine the airflow characteristics and distribution. The height 30 of the inner ring 32 and angle of the ring wall may also be controlled and selected to produce the desired ring configurations and to optimize airflow characteristics.

In another embodiment, the inner surface 38 of ring 32 has an arcuate rather than a flat shaped surface. The outer surface of ring 32 and inner surface 42 of the outer rim 34 have corresponding arcuate surfaces in this embodiment.

The rim 34 preferably has a lower edge that is streamlined to contribute to facilitating the outward jet flow from the upper outside surface 40 of the ring 32.

The edge of the circumference of the upper opening of the ring 32 may be rounded. In another embodiment, the leading upper edge has a blade like taper that divides the airflow to flow over the outer surface 40 of the ring 32 or through the central opening 48 of the ring 32.

A top perspective view of the diffuser 14 without the fan and support structure elements is shown in FIG. 4. This perspective allows a view of the upper edge and upper interior surfaces of the rim 34 as well as the outer surface 40 and leading edge of the ring 32.

In this embodiment, the rim 34 also has a generally vertical wall that serves as a shroud 44 to contain fan blade 20 tip pressure losses to improve the air-moving efficiency of the fan 12 and diffuser 14. The shroud 44 may therefore extend vertically from slightly above the level of the fan blades 20 to slightly below them in one embodiment.

In another embodiment, the rim 34 has a lower ledge 46 that prevents the rotating fan blades 20 from dropping below the rim 34, or rising above it, thereby preventing collisions with the upward or downward support struts of the rim. The rim 34 thereby confines the fan tips in this illustration.

The rim 34 and ring 32 may also improve the safety of ceiling fans in locations where occupants could collide with rotating blades. The rim 34 prevents contact with the blade tips, and the ring 32 reduces the possibility of entry to the blades 20 from below. Even if one puts one's fingers in the spaces between the rim 34 and the ring 32, the slope of the fan blades will knock the fingers back out without catching them.

In one embodiment, the rim 34 and ring 32 of the diffuser 14 may also provide a structure which could be covered with a mesh that could further improve the safety of the fan by preventing objects from coming in contact with the rotating blades.

Figure 5:
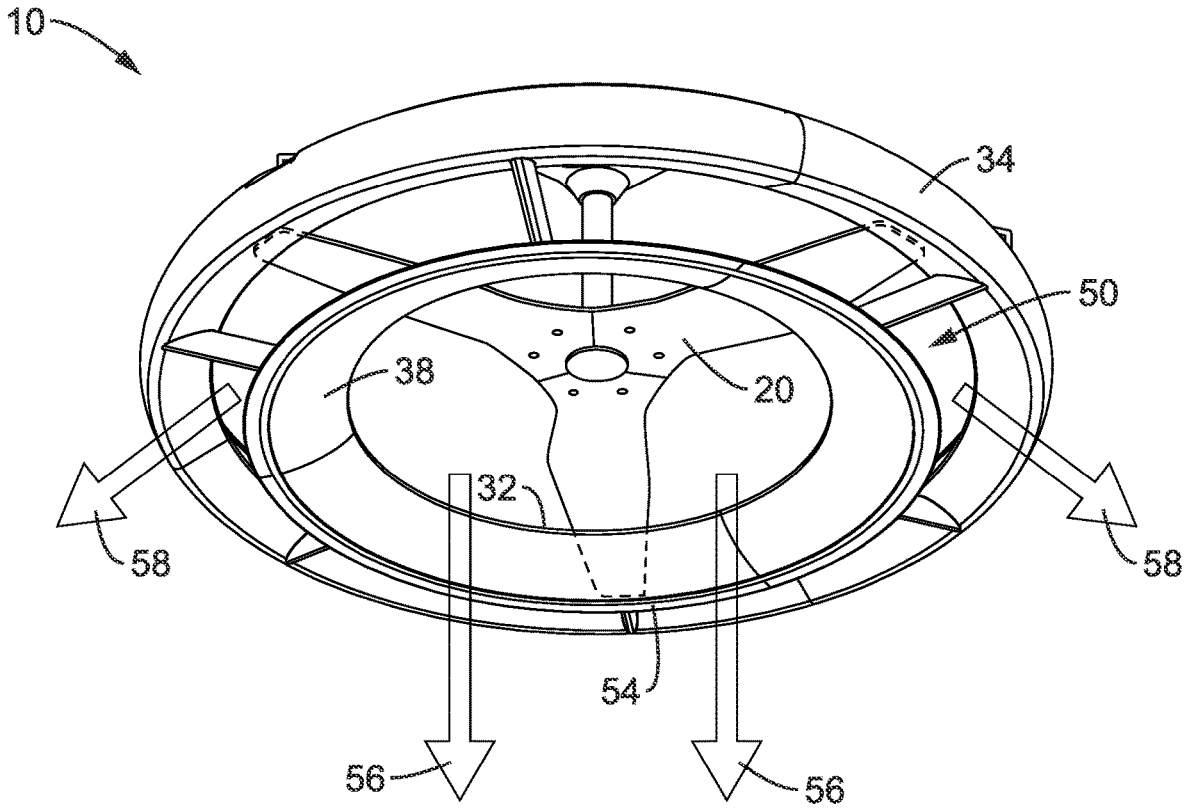
FIG. 5 is a bottom perspective view of the system with diffuser body, support structure and suspended fan showing airflow jets and lighting features according to one embodiment of the technology.

Referring now to FIG. 5, a bottom perspective view of the system 10 mounted to the ceiling in conjunction with a ceiling fan is shown. The rim 34 suspends the ring 32 with via short air-foil shaped struts 36 as well as structurally connects the diffuser 14 to the ceiling via the suspension structure 16, each leg 26 leading to a mounting bracket 24 that is mounted surrounding the base of the ceiling fan 12. The diffuser element 14 is centered under the blades 20 of the fan 12 with the inner ring 32 positioned entirely under the fan blades 20.

Optionally, lighting can be installed anywhere in the apparatus such as inner surface of the bottom edge of the truncated cone of the inner ring 32, or along the upper and lower rims of the outer supporting circle of the outer rim 34. For example, lighting such as LED lighting strips 52, can be installed on the outer rim 34 and/or the inner ring 32. Integrating lighting with ceiling fan lowers total cost and reduces the coordination required between the fan and lighting systems.

As shown in FIG. 5, lighting strips 54 can be mounted to the bottom circumference of the inner ring 32 and oriented downward to provide directed lighting. Lighting strips or other light sources can also be mounted to the sides or bottom of the outer rim 34. When a light ring, lighting strip or other type of light source 52, 54 is included, one of the struts is preferably thick enough to house low voltage wiring for the light source.

Additionally, a lighting strip 52 could be directed upward to the ceiling from the outer rim 34 or inner ring 32, to provide indirect lighting to the room reflected off the ceiling. As illustrated in FIG. 4, a light ring, light strip or other light source 52 can be mounted to the top surface or edge of the outer rim 34.

The light sources that are directed upwardly 52 or downwardly 54 will be outside of the fan blades 20 and therefore will not produce a flicker typically produced by conventional ceiling fans. In addition, the surfaces of the apparatus visually block view of moving fan blades, thereby further reducing visual flicker.

An additional optional feature is that the upward-directed lighting 52 could include UV-C ultraviolet LED lamps, to kill or inhibit airborne pathogens being swept from above and into the inlet of the fan. Upper-room UV-C lighting has been shown to provide efficient bacterial and viral sterilization within a room, while preventing the ultraviolet radiation from entering occupants' eyes. The positioning of UV light 52 to sweep the inlet area of fans is effective in that it continuously draws a large volume of room air closely past the UV lights.

Airflow jets from the diffuser 14 distribute air circulated by the fan to eliminate air pockets, air stratification, and minimize inconsistent temperatures throughout the room. As illustrated with arrows in FIG. 5, airflow jets 58 are emitted diagonally outward from the space 50 between the outer edge 40 of the diffuser ring 32 and the inner edge 42 of the rim 34. In addition, airflow jets 56 are also emitted directly downward from the center opening 48 of the inner ring 32.

Because only a portion of the airflow from the fan 14 goes through the open center 48 of the ring 32, the air velocity directly under the blades 20 is reduced while velocities are increased in the circumferential volume of occupied zone that lies outside of the downward-projected diameter of the fan blades. As these jets dissipate, they entrain surrounding air and create an air speed distribution that is both elevated and more uniform throughout a much broader occupied zone.

Accordingly, the ring 32 creates a more uniform velocity field. The diameter of the inner open center 48 controls the amount of downward airflow under the fan blades. The slope of the cone shape of the inner ring 32 enlarges the effective coverage of the fan outside of the fan blades by directing a ring jet outward while minimizing frictional and pressure-drop losses through the diffusing ring 32. The ring 32 can have an airfoil cross section to minimize flow separation, but testing has shown that it will also function when fabricated from flat sheet material. The taper of the cone, its angle, and the cone width, and the separation distance between rim 34 and ring 32, will depend on the particular fan that is selected and will be determined during manufacturing.

From the description herein, it will be appreciated that the present disclosure encompasses multiple implementations of the technology which include, but are not limited to, the following:

An airflow diffuser apparatus, comprising: (a) an outer rim with an annular opening; (b) a concentric inner ring with a frustoconical outer wall and central opening positioned coaxially in the annular opening of the outer rim; and (c) a plurality of struts interconnecting the inner ring and the outer ring; (d) wherein the inner ring is configured to redirect portions of fan airflow laterally outward and downward thereby increasing an amount and uniformity of occupant cooling enabled by a fan.

The apparatus of any preceding or following implementation, further comprising a diffuser support structure with a mount and a plurality of elongate legs coupled to the mount at one end and to the diffuser outer rim at the other.

The apparatus of any preceding or following implementation, wherein the plurality of elongate legs are selected from the group consisting of metal rods, telescoping tubes and wire cables.

The apparatus of any preceding or following implementation, wherein the outer rim further comprises an inner frustoconical wall with an angle matching the outer wall of the inner ring.

The apparatus of any preceding or following implementation, wherein the outer rim further comprises an inner circumferential ledge and shroud in a top surface of the outer rim with a diameter sized to contain fan blades of a fan.

The apparatus of any preceding or following implementation, wherein the outer rim further comprises a source of visible light directed in either an upward or downward direction.

The apparatus of any preceding or following implementation, the outer rim further comprising an integrated UV-C light source oriented in an upward direction to inhibit or kill airborne pathogens exposed to the light source.

The apparatus of any preceding or following implementation, the inner ring further comprising an integrated visible light source directed in a downward direction.

The apparatus of any preceding or following implementation, wherein the struts have an airfoil shape.

A ceiling fan airflow diffuser system, the system comprising: (a) a ceiling fan with two or more fan blades; (b) a diffuser body comprising: (i) an outer rim with a top surface forming a shroud and an annular opening; (ii) a truncated cone-shaped inner ring with a diameter that is smaller than the annular opening of the outer rim positioned coaxially in relation to the outer rim, the inner ring with a central opening; and (iii) a plurality of struts interconnecting the inner ring and the outer rim; and (c) a diffuser support structure coupled to the diffuser body and configured to be mounted to a ceiling; (d) wherein in use, the inner ring functions to redirect airflow from the ceiling fan outward into a larger region below the fan.

The system of any preceding or following implementation, wherein the outer rim further comprises an inner frustoconical shaped wall facing an outer wall of the inner ring.

The system of any preceding or following implementation, wherein the outer rim further comprises a source of visible light directed in either an upward or downward direction.

The system of any preceding or following implementation, the outer rim further comprising an integrated UV-C light source oriented in an upward direction to inhibit or kill airborne pathogens exposed to the light source.

The system of any preceding or following implementation, the inner ring further comprising an integrated visible light source directed in a downward direction.

The system of any preceding or following implementation, wherein the struts have an airfoil shape.

A fan airflow diffuser and lighting apparatus, comprising: (a) a diffuser support structure configured to be mounted to a ceiling; and (b) a diffuser body coupled to the support structure, comprising: (i) an outer rim with an annular opening and a first light source; (ii) a frustoconical inner ring with an angled outer wall and a diameter that is smaller than the annular opening of the outer rim, the ring positioned coaxially in relation to the outer rim, the inner ring with a central opening, the inner ring with a second light source; and (iii) a plurality of struts interconnecting the inner ring and the outer rim: (c) wherein a diameter of the inner ring central opening and the slope of the outer wall of the inner ring determine air movement coverage area and magnitude of air velocity in the coverage area generated by a ceiling fan.

The apparatus of any preceding or following implementation, wherein the outer rim further comprises an inner frustoconical wall with an angle matching the angled outer wall of the inner ring.

The apparatus of any preceding or following implementation, wherein the outer rim further comprises an inner circumferential ledge and shroud in a top surface of the outer rim with a diameter sized to contain fan blades of a fan.

The apparatus of any preceding or following implementation, wherein the first light source comprises a light strip producing visible light directed in an upward direction and the second light source comprises a light strip producing visible light directed in a downward direction.

The apparatus of any preceding or following implementation, wherein the first light source comprises an integrated UV-C light source oriented in an upward direction to inhibit or kill airborne pathogens exposed to the light source and the second light source comprises a light strip producing visible light directed in a downward direction.

As used herein, term "implementation" is intended to include, without limitation, embodiments, examples, or other forms of practicing the technology described herein.

As used herein, the singular terms "a," "an," and "the" may include plural referents unless the context clearly dictates otherwise. Reference to an object in the singular is not intended to mean "one and only one" unless explicitly so stated, but rather "one or more."

Phrasing constructs, such as "A, B and/or C", within the present disclosure describe where either A, B, or C can be present, or any combination of items A, B and C. Phrasing constructs indicating, such as "at least one of" followed by listing a group of elements, indicates that at least one of these group elements is present, which includes any possible combination of the listed elements as applicable.

References in this disclosure referring to "an embodiment", "at least one embodiment" or similar embodiment wording indicates that a particular feature, structure, or characteristic described in connection with a described embodiment is included in at least one embodiment of the present disclosure. Thus, these various embodiment phrases are not necessarily all referring to the same embodiment, or to a specific embodiment which differs from all the other embodiments being described. The embodiment phrasing should be construed to mean that the particular features, structures, or characteristics of a given embodiment may be combined in any suitable manner in one or more embodiments of the disclosed apparatus, system or method.

As used herein, the term "set" refers to a collection of one or more objects. Thus, for example, a set of objects can include a single object or multiple objects.

Relational terms such as first and second, top and bottom, upper and lower, left and right, and the like may be used solely to distinguish one entity or action from another entity or action without necessarily requiring or implying any actual such relationship or order between such entities or actions.

The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element.

As used herein, the terms "approximately", "approximate", "substantially", "essentially", and "about", or any other version thereof, are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

The term "coupled" as used herein is defined as connected, although not necessarily directly and not necessarily mechanically. A device or structure that is "configured" in a certain way is configured in at least that way but may also be configured in ways that are not listed.

Benefits, advantages, solutions to problems, and any element(s) that may cause any benefit, advantage, or solution to occur or become more pronounced are not to be construed as a critical, required, or essential features or elements of the technology describes herein or any or all the claims.

In addition, in the foregoing disclosure various features may grouped together in various embodiments for the purpose of streamlining the disclosure. This method of disclosure is not to be interpreted as reflecting an intention that the claimed embodiments require more features than are expressly recited in each claim. Inventive subject matter can lie in less than all features of a single disclosed embodiment.

The abstract of the disclosure is provided to allow the reader to quickly ascertain the nature of the technical disclosure. It is submitted with the understanding that it will not be used to interpret or limit the scope or meaning of the claims.

It will be appreciated that the practice of some jurisdictions may require deletion of one or more portions of the disclosure after that application is filed. Accordingly, the reader should consult the application as filed for the original content of the disclosure. Any deletion of content of the disclosure should not be construed as a disclaimer, forfeiture or dedication to the public of any subject matter of the application as originally filed.

The following claims are hereby incorporated into the disclosure, with each claim standing on its own as a separately claimed subject matter.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A fan airflow diffuser and lighting apparatus, comprising:

(a) a diffuser support structure configured to be mounted to a ceiling; and (b) a diffuser body coupled to the support structure, comprising:

(i) an outer rim with an annular opening and a first light source producing visible light or UV-C light directed in an upward direction;

(ii) a frustoconical inner ring with an angled outer wall and a diameter that is smaller than the annular opening of the outer rim, the ring positioned coaxially in relation to the outer rim, the inner ring with a central opening, the inner ring with a second light source of a light strip producing visible light directed in a downward direction; and (iii) a plurality of struts interconnecting the inner ring and the outer rim:

(c) wherein a diameter of the inner ring central opening and the slope of the outer wall of the inner ring determine air movement coverage area and magnitude of air velocity in the coverage area generated by a ceiling fan.

2. The apparatus of claim 1, wherein said outer rim further comprises an inner frustoconical wall with an angle matching the angled outer wall of the inner ring.

3. The apparatus of claim 1, wherein said outer rim further comprises an inner circumferential ledge and shroud in a top surface of the outer rim with a diameter sized to contain fan blades of a fan.

* * * * *